US006755919B2

(12) United States Patent
Toyooka et al.

(10) Patent No.: US 6,755,919 B2
(45) Date of Patent: Jun. 29, 2004

(54) STAINLESS STEEL TUBE FOR AUTOMOBILE STRUCTURE

(75) Inventors: Takaaki Toyooka, Handa (JP); Akira Yorifuji, Handa (JP); Makoto Kitazawa, Handa (JP); Yoshikazu Kawabata, Handa (JP); Motoaki Itadani, Handa (JP); Masatoshi Aratani, Handa (JP); Takatoshi Okabe, Handa (JP)

(73) Assignee: JFE Steel Corporation, Tokyo (JP)

( * ) Notice: Subject to any disclaimer, the term of this patent is extended or adjusted under 35 U.S.C. 154(b) by 74 days.

(21) Appl. No.: 10/089,035

(22) PCT Filed: Jul. 17, 2001

(86) PCT No.: PCT/JP01/06155

§ 371 (c)(1),
(2), (4) Date: Mar. 26, 2002

(87) PCT Pub. No.: WO02/10469

PCT Pub. Date: Feb. 7, 2002

(65) Prior Publication Data

US 2003/0057695 A1 Mar. 27, 2003

(30) Foreign Application Priority Data

Jul. 27, 2000 (JP) ..... 2000-226832

(51) Int. Cl.[7] ..... C22C 38/18
(52) U.S. Cl. ..... 148/325

(58) Field of Search ..... 148/325, 909

(56) References Cited

U.S. PATENT DOCUMENTS 4,799,972 A * 1/1989 Masuyama et al. ..... 148/325

FOREIGN PATENT DOCUMENTS

| | | |
|---|---|---|
| EP | 924312 A | 6/1999 |
| JP | 5-329513 A | 12/1993 |
| JP | 6-41689 | 2/1994 |

* cited by examiner

*Primary Examiner*—Deborah Yee
(74) *Attorney, Agent, or Firm*—Young & Thompson

(57) ABSTRACT

A stainless steel tube having excellent formability for secondary operation comprises: a chemical composition including not more than 0.20 mass % of C; not more than 1.5 mass % of Si; not more than 2.0 mass % of Mn; 10–18 mass % of Cr; not more than 0.03 mass % of N; or further at least one type of element selected from the group of: not more than 0.6 mass % of Cu; not more than 0.6 mass % of Ni; not more than 2.5 mass % of Mo; not more than 1.0 mass % of Nb; not more than 1.0 mass % of Ti; and not more than 1.0 mass % of V; Fe as the remainder and the inevitable impurities; and a structure constituted of ferrite or ferrite and martensite, wherein the TE value defined by the following formula exceeds 25,000 Mpa·%, TE=TS×(El+21.9) TS represents the tensile strength in the tube axial direction, and El represents the elongation in such direction.

3 Claims, 2 Drawing Sheets

STAINLESS STEEL TUBE FOR AUTOMOBILE STRUCTURE

FIELD OF THE INVENTION

The present invention relates to a stainless steel tube which is used for a automobile structure member, and more specifically, to a stainless steel tube which exhibits excellent formability for secondary operation in diameter-reducing/increasing, bending, twisting and the like. In the present invention, "a automobile structure member" represents members, for example, a chassis member, a bumper, a frame and the like.

BACKGROUND ART

A stainless steel tube used for a automobile structure member has conventionally been produced by cold forming a stainless steel sheet. In such cold forming, low-strain forming is generally carried out in order to avoid deterioration of ductility due to the forming strain.

SUMMARY OF THE INVENTION

However, in such low-strain forming, strain caused by cold forming still inevitably result in work-hardening by processing. That is, the problem of deteriorated ductility of the produced tube remains unsolved. In particular, in applications in which the product is subjected to a bending process after a diameter-reducing process, the deterioration of ductility due to the cold forming directly results in generation of cracks or too thin thickness portions in the product during the diameter-reducing process or bending process thereafter. Accordingly, a tube product produced by cold low-strain forming cannot be employed, in a satisfactory manner, for applications in which a bending process is carried out after a diameter-reducing process.

In order to solve the aforementioned problem in an advantageous manner, an object of the present invention is to provide a steel tube which is significantly more excellent in ductility than the conventional steel tube as compared at the same tensile strength level and generates no cracks and few too-thin portions therein during a diameter-reducing process or a bending process thereafter. Specifically, the object of the present invention is to provide a stainless steel tube for a automobile structure member which is excellent in the composite (diameter-reducing and bending) formability, and also excellent in formability for secondary operation in, for example, diameter-reducing/increasing, bending and twisting.

The inventors of the present invention have studied the factors for improving formability for secondary operation in, for example, diameter-reducing/increasing, bending and twisting, with respect to a stainless steel tube containing Cr. As a result, the inventors have discovered that such a stainless tube exhibits excellent formability for secondary operation only when the chemical composition, the micro structure, the tensile strength and ductility thereof are arranged in a certain range. The present invention has been achieved on the basis of this discovery.

Specifically, in the present invention, a stainless steel tube for a automobile structure member having excellent formability for secondary operation comprises: a chemical composition including not more than 0.20 mass % of C; not more than 1.5 mass % of Si; not more than 2.0 mass % of Mn; 10–18 mass % of Cr; not more than 0.03 mass % of N; Fe as the remainder and the inevitable impurities; and a microstructure which is constituted of ferrite or ferrite and martensite, wherein the TE value defined by the following formula (1) exceeds 25,000 MPa·%.

$$TE\ \text{value} = TS \times (El + 21.9) \quad (1)$$

(In the aforementioned formula, TS represents the tensile strength in the tube axial direction (MPa), and El represents the elongation in the tube axial direction (%)). In the stainless steel tube of the present invention, the Lankford value preferably exceeds 0.5.

In the stainless steel tube of the present invention, the diameter of ferrite grain is preferably not larger than 8 $\mu$m. In addition, in the stainless steel tube of the present invention, it is preferable that martensite is contained so that the area ratio thereof is not more than 30%.

Further, in the present invention, in addition to the aforementioned chemical composition, it is preferable that at least one type of element selected from the group consisting of: not more than 0.6 mass % of Cu; not more than 0.6 mass % of Ni; not more than 2.5 mass % of Mo; not more than 1.0 mass % of Nb; not more than 1.0 mass % of Ti; and not more than 1.0 mass % of V is contained.

Yet further, the present invention is directed to a automobile structure member having excellent fatigue resistance property, which member is produced by subjecting any of the aforementioned types of stainless steel tube to a secondary forming and a heat refining treatment so that the tensile strength thereof reaches not smaller than 800 MPa.

Figure 1:
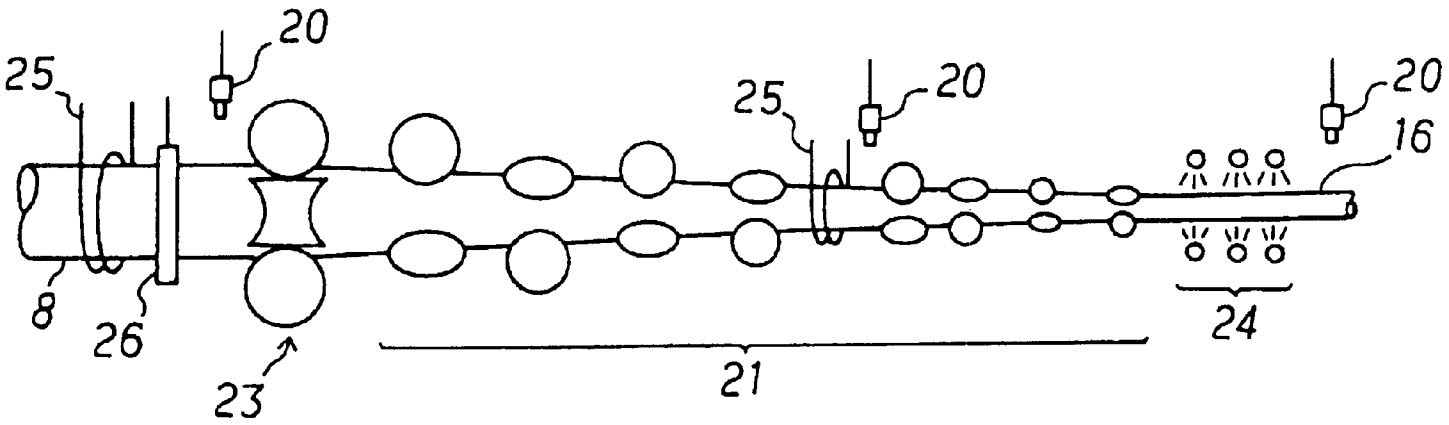
FIG. 1 is a schematic diagram which shows one example of a facility arrangement suitable for implementing the present invention.

| <Explanation of the Numerals> | |
|---|---|
| 8 | Mother Pipe |
| 16 | Product Pipe |
| 20 | Thermometer |
| 21 | Diameter-reducing Device |
| 23 | Descaling Device |
| 24 | Rapid-cooling Device |
| 25 | Reheating Device |
| 26 | Cooling Device |

THE PREFERRED EMBODIMENTS OF THE PRESENT INVENTION

In terms of achieving excellent productivity and facilitating excellent manifestation of the effect, a stainless steel tube of the present invention is preferably produced by hot diameter-reducing rolling of a mother tube which is a welded-tube. As the mother tube, an electric resistance welded steel tube (seam welded steel tube) produced by the electric resistance welding method using high frequency electric current, or a solid phase pressure welded steel tube produced by pressure welding after heating both edge portions of an open tube to the temperature range of solid phase pressure welding, or a butt-welded steel tube, are preferably used.

The reason for restricting the chemical composition of the steel tube of the present invention to the aforementioned level will be described hereinafter. The unit of the content of each chemical component is mass %, and will be referred to as simply "%" hereinafter.

C: not more than 0.20%

C is to be contained in order to reliably obtain sufficient strength. However, when C is contained too much, the ductility and the rust resistance property of steel deteriorate. Accordingly, the content of C is restricted to not more than 0.20%. Preferably, the content of C is not more than 0.15%. In order to reliably obtain excellent hardenability property, the content of C is more preferably in a range of 0.003 to 0.15%.

Si: not more than 1.5%

Si is to be essentially contained in steel, as a deoxidizing element. However, when Si is contained too much, formability of steel deteriorates. Accordingly, the content of Si is restricted to not more than 1.5%. Preferably, the content of Si is in a range of 0.15 to 1.0%.

Mn: not more than 2.0%

Mn is to be essentially contained in steel, so that the content thereof is preferably not less than 0.15%, in order to deoxidize and desulfurize the steel and improve the hot workability. However, Mn forms sulfides thereof in the steel and deteriorates the corrosion resistance property of the steel. Accordingly, the lower the content of Mn is the better. However, considering the cost-cutting at the time of producing steel, the content of Mn is acceptable if the content thereof does not exceed 2.0%. Preferably, the content of Mn is not more than 1.50%.

Cr: 10 to 18%

Cr is to be essentially contained in steel in order to provide corrosion resistance property thereto. When the content of Cr is less than 10%, the resulting stainless steel cannot reliably obtain corrosion resistance of the normally required level. On the other hand, when the content of Cr exceeds 18%, the resulting stainless steel becomes brittle, which is problematic in production. Accordingly, the content of Cr is restricted to a range of 10 to 18%.

N: not more than 0.03%

N is to be contained in order to reliably obtain sufficient strength. However, when N is contained too much, the ductility and the rust resistance property of steel deteriorate. Accordingly, the content of N is restricted to not more than 0.03%. Preferably, the content of N is not more than 0.010%.

In addition, in the present invention, at least one type of element selected from the group consisting of: not more than 0.6% of Cu; not more than 0.6% of Ni; not more than 2.5% of Mo; not more than 1.0% of Nb; not more than 1.0% of Ti; and not more than 1.0% of V may further be contained.

Cu, Ni, Mo, Nb, Ti and V are all elements which improve the corrosion resistance of steel. At least one type of element selected from the aforementioned group of the elements may be selectively contained in steel, according to necessity.

Cu is an element which improves the rust resistance property, in particular, among the corrosion resistance properties, and may be contained in steel according to necessity. However, when Cu is contained too much, the hot workability of steel deteriorates. Accordingly, the upper limit of the Cu content is preferably restricted to 0.6%. More preferably, the content of Cu is in a range of 0.30 to 0.40%.

Ni is contained in steel in order to effect further improvement of the rust resistance property, in particular, among the corrosion resistance properties. However, when Ni is contained too much, the economical disadvantages exceeds the advantages achieved by the effect of Ni addition. Accordingly, the upper limit of the content of Ni is preferably restricted to 0.6%. More preferably, the content of Ni is not more than 0.4%.

Mo is an element which is effective for maintaining the corrosion resistance property. Mo is especially effective for improving the pitting corrosion resistance property and the capability of recovering the passive state of steel. However, when Mo is contained too much, the economical disadvantages exceeds the advantages achieved by the effect of Mo addition, and the steel tends to become brittle. Accordingly, the upper limit of the content of Mo is preferably restricted to 2.5%. More preferably, the content of Mo is not more than 1.5%.

Nb improves the corrosion resistance property of steel, by fixing C and N. In addition, Nb facilitates accumulation of strains caused by diameter-reducing rolling, thereby increasing the number of the transformation nucliation sites and achieving a further more excellent effect of refining the ferrite grain size. However, when the content of Nb exceeds 1.0%, Nb forms intermetallic compounds, whereby the formability of steel is deteriorated. Accordingly, the content of Nb is preferably restricted to not more than 1.0%. More preferably, the content of Nb is not more than 0.5%.

Ti improves the corrosion resistance property of steel, by fixing C and N. In addition, Ti suppresses the growth of ferrite grains in the ferrite+austenite ($\alpha+\gamma$) range, thereby achieving a further more excellent effect of refining the ferrite grain size. However, when Ti is contained too much, the elements thereof (Ti compounds) tend to precipitate by larger amounts, whereby surface properties of the steel deteriorate. Accordingly, the content of Ti is preferably restricted to not more than 1.0%. More preferably, the content of Ti is not more than 0.5%.

V improves the corrosion resistance property of steel, by fixing C and N. In addition, V suppresses the growth of ferrite grains in the ferrite+austenite ($\alpha+\gamma$) range, thereby achieving a further more excellent effect of refining the ferrite grain size. However, when V is contained too much, the elements thereof (V compounds) tend to precipitate by larger amounts, whereby surface of the steel deteriorate. Accordingly, the content of V is preferably restricted to 1.0%. More preferably, the content of V is not more than 0.2%.

The steel tube of the present invention contains, as the remainder other than the aforementioned elements, Fe and inevitable impurities.

As the inevitable impurities, not more than 0.008% of O, not more than 0.045% of P and not more than 0.020% of S are acceptable.

O, which acts as an oxide, deteriorates the cleanness of steel. Accordingly, it is preferable that the content of O is decreased as much as possible. However, the presence of O is acceptable as long as the content thereof does not exceed 0.008%.

The element P locally segregates at the grain boundary and deteriorates toughness. Accordingly, it is preferable that the content of P is decreased as much as possible. However, the presence of P is acceptable as long as the content thereof does not exceed 0.045%.

The element S increases the amount of sulfides and deteriorates the cleanness of steel. Accordingly, it is preferable that the content of S is decreased as much as possible. However, the presence of S is acceptable as long as the content thereof does not exceed 0.020%.

Next, the reason for the aforementioned restriction of the micro-structure of the steel tube of the present invention will be described.

The stainless steel tube of the present invention has a micro-structure which is constituted of ferrite (F) or ferrite (F) and martensite (M)

Here, it is preferable that martensite (M) is contained so that the area ratio thereof is not more than 30%. When the area ratio of martensite (M) exceeds 30%, the TE value decreases.

In a micro-structure other than the aforementioned micro-structure, at least one of tensile strength and ductility are insufficient, whereby the formability for secondary operation in diameter-reducing/increasing, bending, twisting and the like (including combination thereof) is poor. In the present invention, when the micro-structure is constituted of ferrite and the diameter of ferrite grain is not larger than 8 μm, the formability for secondary operation is further improved. That is, such a micro-structure is especially preferable.

Next, the reason for the aforementioned restriction of the mechanical properties of the steel tube of the present invention will be described.

It is understood, from the results of the experiments assiduously conducted by the inventors of the present invention, that excellent formability for secondary operation of a steel tube cannot be obtained, if the TE value thereof defined by the aforementioned formula (1) is 25,000 MPa·% or less, although the requirements of the present invention are satisfied for the chemical composition and the micro-structure. In other words, in a steel tube whose TE value is 25,000 MPa·% or less, excellent formability for secondary operation, in particular, excellent combined (diameter-reducing and bending) formability as a material for a automobile structure member cannot be reliably obtained. Accordingly, the mechanical property of the present invention is restricted so that the TE value exceeds 25,000 MPa·%.

In addition, when further more excellent formability for secondary operation, in particular, further more excellent combined (diameter-reducing and bending) formability is to be pursued, it is preferable that the Lankford value of the steel tube exceeds 0.5. Here, the Lankford value (the r value) of a steel tube is obtained by: taking a JIS(Japanese Industrial Standards) No. 12 test piece from a steel tube to be measured according to the regulation of JIS Z 2201; sticking a strain gauge at the center of the test piece (steel tube piece) at the outer surface side thereof, carrying out a tensile test according to the regulation of JIS Z 2241; obtaining, in the uniform-elongation area, two sets of corresponding width-direction strain $E_W$ and longitudinal-direction strain $E_L$ i.e., $\{E_{W(1)}, E_{L(1)}\}$, $\{E_{W(2)}, E_L(2)\}$; and calculating the Lankford value according to the following formula.

$$r=a/(-1-a)$$

In the aforementioned formula, $$a=\{E_{W(2)}-E_{W(1)}\}/\{E_{L(2)}-E_{L(1)}\}$$

Next, a preferable method of producing a stainless steel tube of the present invention will be described hereinafter.

The stainless steel tube of the present invention is preferably produced as a product tube by hot diameter-reducing rolling of a mother tube which is a welded tube having the aforementioned chemical composition.

In diameter-reducing rolling, rolling processing is performed in the biaxial-stress state, whereby an excellent grain refining effect can be obtained. Due to this effect, the ductility of the diameter-reduced product tube is further more improved as compared with the conventional product, at the same level of tensile strength. On the other hand, in the case of rolling of a steel sheet, free ends exist in the sheet-width direction (the direction traverse to the rolling direction), as well as in the rolling direction. Therefore, the steel sheet rolling process is performed in the uniaxial-stress state, whereby the grain size refining effect encounters a limit.

As the hot diameter-reducing rolling method, a method using a reducer in which a plurality of kaliber rolling mills are arranged in tandem is preferable. One example of facility arrangement suitable for implementing the present invention is shown in FIG. 1. In FIG. 1, a diameter-reducing rolling device 21 constituted of a plurality of stands having kaliber rolls. The number of the stands of the rolling mills is determined, in an appropriate manner, according to the relationship between the diameter of the mother tube and the diameter of the produced tube. The number of kaliber roll can be preferably applied to any of the conventionally known kaliber rolls of 2-roll, 3-roll and 4-roll types.

The preferable diameter-reducing rolling conditions are as follows: the heating (including soaking) temperature prior to diameter-reducing rolling being in a range of 700 to 900° C.; the temperature at which rolling is performed being in a range of 700 to 900° C.; and the diameter-reducing rate being not smaller than 30%. Here, the diameter-reducing rate=(1−outer diameter after rolling/outer diameter before rolling)×100 (%).

When the heating temperature exceeds 900° C., the steel surface property deteriorates and the austenite grains become coarse during the heating, whereby grain refining of the product tube cannot be achieved. On the other hand, when the heating temperature is lower than 700° C., a preferable rolling temperature cannot be reliably obtained. Accordingly, the heating temperature is preferably in a range of 700 to 900° C. In this heating method, heating is preferably conducted by a heating furnace or induction heating. The induction heating method is particularly preferable because the induction heating method achieves a high heating rate, thereby enhancing production efficiency and suppressing the growth of grains.

The rolling temperature is preferably in a range of 700 to 900° C. This temperature range corresponds to the temperature range from the two-phase region of austenite and ferrite to the ferrite region. When rolling is carried out in the range from the two-phase region to the ferrite region, the ferrite grains or the ferrite grains and the austenite grains are deformed, recrystallized and refined due to the strain. As a result of this refining process being repeated, the structure after rolling can be made fine. When the temperature at which rolling is carried out exceeds 900° C., the temperature is in the austenite region and thus the structure after rolling becomes a single-phase structure of martensite, whereby the structure of the steel tube of the present invention which is excellent in formability for secondary operation can not longer be obtained. On the other hand, when the temperature at which rolling is carried out is below 700° C., recrystallization does not occur in a sufficient manner, whereby ductility of the product deteriorates. Accordingly, the temperature at which rolling is carried out is preferably in a range of 700 to 900° C.

Figure 2:
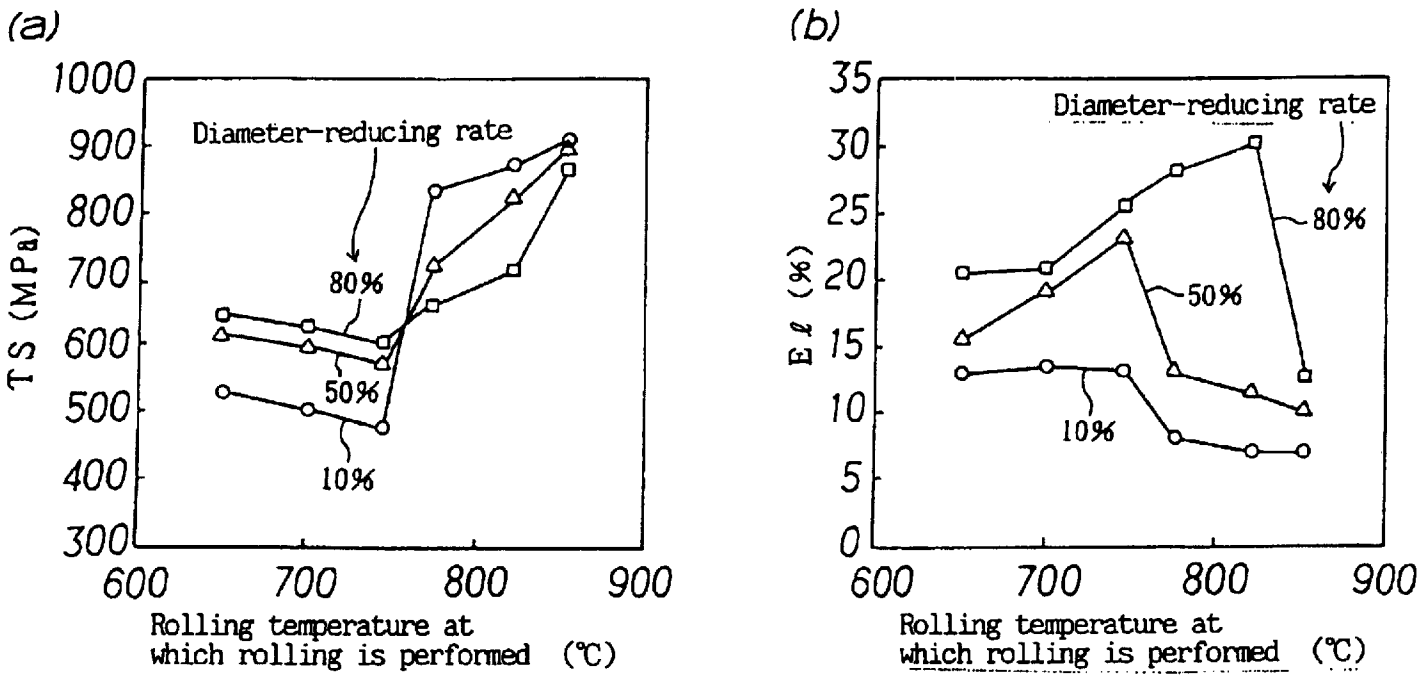
FIG. 2 is a graph which shows the influence of the diameter-reducing rolling temperature and the diameter-reducing rate on the tensile strength and the elongation of the product tube.

In order to make the structure further finer, the temperature at which rolling is carried out is preferably not higher than 830° C. For example, FIG. 2 is a graph which shows the influence of the temperature at which hot diameter-reducing rolling is performed and the diameter-reducing rate on TS (tensile strength) and El (elongation) of steel tubes as products. These product tubes are obtained by hot diameter-reducing rolling a seam welded stainless steel tube as the mother tube which has the chemical composition corresponding to JIS SUS 410 (C: 0.01%, Si: 0.15%, Mn: 1.5%, Cr: 11%, Cu: 0.15%, Ni: 0.15%). As shown in FIG. 2, in a case in which the diameter-reducing rate is relatively high, El significantly decreases when the temperature at which rolling is carried out exceeds 830° C.

The preferable temperature range (700 to 900° C., and more preferably 700 to 830° C.) within which diameter-reducing rolling is to be performed is not so wide. Therefore, in order to prevent the temperature from depressing too low during rolling, it is preferable that the rolled tube is reheated during the diameter-reducing rolling process (which heating will be referred to as "the intermediate heating"). This intermediate heating can be carried out by using a reheating device 25 constituted of, for example, an induction coil provided between stands as shown in FIG. 1. In order to control the temperature at which rolling is started, it is preferable that the reheating device 25 and a cooling device 26 are both provided, in a combined manner, at the entry side of the diameter-reducing rolling device 21.

When the diameter-reducing rate of rolling is less than 30%, the strain is insufficient and recrystallization does not enhanced in a satisfactory manner, whereby the ferrite grains and the austenite grains fail to be refined and thus the refining of the structure after the rolling process cannot be achieved. In addition, when the diameter-reducing rate of rolling is less than 30%, the formation of the rolling texture may not be sufficient. As a result, in this case, it is difficult to obtain a product tube which is excellent in both tensile strength and ductility, as shown in FIG. 2. Due to this, it is preferable that the diameter-reducing rate is not smaller than 30%. The diameter-reducing rate of 50% or more is more preferable because the structure is then further more refined.

In the diameter-reducing rolling process, it is preferable that the rolling passes include at least one rolling pass in which the diameter-reducing rate/pass (=the diameter-reducing rate per one pass) is not smaller than 5%. In a rolling pass in which the diameter-reducing rate/pass is not smaller than 5%, dynamic recrystallization is observed and grain refining more excellently proceeds. In addition, as the temperature increases due to the heat generated by the rolling, decrease of the temperature during rolling can be prevented.

In the present invention, the diameter-reducing rolling process is preferably performed as the rolling with lubrication. When the diameter-reducing rolling is performed as the rolling with lubrication (lubrication rolling), the distribution of strain in the thickness direction of the product is uniform and the distribution of the grain diameter size is also uniform in the thickness direction. If the rolling process is conducted without lubrication, strains tend to concentrate on only the surface layer portion of the material due to the shearing effect, whereby the grain size is likely to be unequal in the thickness direction of the product. The lubrication rolling can be carried out by using a rolling oil which is a conventionally known mineral oil or a mixture of a conventionally known mineral oil and a synthetic ester.

After the diameter-reducing rolling is performed, the steel tube is cooled to the room temperature. Such cooling may be carried out by air-cooling. However, in order to suppress the grain growth as much as possible, it is preferable that the cooling is rapidly conducted at a cooling rate of not lower than 10° C./s. For this purpose, a rapid-cooling device 24 may be provided at the exit side of the diameter-reducing rolling device 21, so that water cooling, mist cooling, air-blast cooling or the like is carried out by the rapid-cooling device.

Further, in the present invention, by subjecting any of the aforementioned types of stainless steel tube to a secondary forming treatment such as diameter-reducing/increasing, bending, twisting in the desired manner and then to a heat refining treatment, a automobile structure member having high tensile strength of 800 MPa or higher and excellent fatigue resistance can be obtained.

The heat refining treatment is preferably carried out as a heat treatment which includes the steps of: heating the steel tube to a temperature in the austenite region or in the austenite+ferrite region; thereafter air cooling or water cooling the steel tube; and then tempering the steel tube at a temperature of the $Ac_3$ transformation point or lower, so that the steel tube has a desired tensile strength (800 MPa or higher).

EXAMPLES

Example 1

The diameter-reducing rolling of a seam welded steel tube as the mother tube (the outer diameter thereof being 146.0 mm) having the chemical composition shown in Table 1 was carried out by using a diameter-reducing rolling device having the structure as shown in FIG. 1 (3 roll type) in the conditions shown in Table 2 and Table 3, whereby a product tube was obtained.

For each of the obtained product tubes, the structure, the tensile property, the Lankford value and the formability for secondary operation were analyzed.

As a result of observing the etching image at a section traverse to the tube axial direction, it was found out that the structure was the F(ferrite) structure or the F(ferrite)+M (martensite) structure. The etching image was image-analyzed and the area ratio of F and the grain diameter were measured. The measurement of the grain diameter was carried out the cutting method.

The tensile strength was measured by using a JIS No. 12 test piece. The ductility was evaluated by the elongation El. The value of the elongation El was calculated as a conversion value which can be obtained by using the following formula, in consideration of the sizing effect of the test piece.

$$El=El_0\times(\sqrt{(a_0/a)})^{0.4}$$

In the aforementioned formula, $El_0$: Actually measured elongation $a_0$: 292 $mm^2$ a: Section area of the test piece ($mm^2$)

The Lankford value was measured by the aforementioned method.

As the formability for secondary operation, the combined formability of the diameter-reducing and the bending was evaluated. Specifically, the combined formability was evaluated by: subjecting, in each type of steel tube, ten test materials to the 20% diameter-reducing process; thereafter subjecting each of the ten test materials to the 45° bending process; and obtaining the crack generation rate for each type of steel tube (which rate is expressed as "x/10" when the number of the materials in which cracks were generated was counted as "x").

The obtained results are shown in Table 2.

As shown in Table 2, the steel tubes of the present examples had high tensile strength and excellent ductility, had a TE value of more than 25,000 MPa·%, and exhibited the excellent combined (diameter-reducing and bending) formability. Accordingly, it is understood that the steel tube of the present invention is a steel tube having excellent formability for secondary operation.

TABLE 1

| Steel | Chemical composition (mass %) | | | | | | | | | | | | |
|---|---|---|---|---|---|---|---|---|---|---|---|---|---|
| | C | Si | Mn | Cr | N | Cu | Ni | Mo | Nb | Ti | V | P | S |
| A | 0.010 | 0.40 | 1.25 | 11.5 | 0.010 | 0.3 | 0.3 | — | — | — | — | 0.018 | 0.002 |
| B | 0.008 | 0.80 | 0.41 | 12.9 | 0.009 | — | — | — | — | 0.2 | — | 0.015 | 0.002 |
| C | 0.010 | 0.25 | 0.40 | 16.0 | 0.010 | — | — | — | — | — | — | 0.019 | 0.002 |
| D | 0.005 | 0.06 | 0.22 | 17.3 | 0.010 | — | — | 0.54 | 0.40 | — | 0.19 | 0.020 | 0.002 |
| E | 0.010 | 0.20 | 0.27 | 25.1 | 0.011 | 1.0 | — | — | — | 0.3 | — | 0.020 | 0.002 |

TABLE 2

| Steel tube No. | Steel No. | Conditions in diameter-reducing rolling | | | | | | Size of product tube | |
|---|---|---|---|---|---|---|---|---|---|
| | | Heating temperature (° C.) | Temperature at which rolling is started (° C.) | Temperature at which rolling is finished (° C.) | Diameter-reducing rate (%) | Intermediate heating | Lubrication rolling | Outer diameter (mm) | Thickness (mm) |
| 1 | B | 735 | 732 | 642 | 30.4 | Performed | Performed | 101.6 | 2.0 |
| 2 | B | 735 | 730 | 628 | 48.6 | Performed | Not performed | 75.0 | 2.1 |
| 3 | B | 735 | 740 | 645 | 60.3 | Not performed | Performed | 57.9 | 2.1 |
| 4 | B | 780 | 776 | 676 | 72.7 | Not performed | Performed | 39.8 | 2.3 |
| 5 | B | as the original electric resistance welded tube | | | | | | 146.0 | 2.1 |
| 6 | A | 735 | 732 | 642 | 30.4 | Performed | Performed | 101.6 | 2.0 |
| 7 | A | 735 | 730 | 628 | 48.5 | Performed | Not performed | 75.2 | 2.1 |
| 8 | A | 735 | 740 | 645 | 60.2 | Not performed | Performed | 58.1 | 2.1 |
| 9 | A | 780 | 776 | 676 | 72.5 | Not performed | Performed | 40.2 | 2.3 |
| 10 | A | as the original electric resistance welded tube | | | | | | 146.0 | 2.0 |
| 11 | C | 735 | 730 | 628 | 48.6 | Performed | Not performed | 75.0 | 2.1 |
| 12 | C | 735 | 740 | 645 | 60.3 | Not performed | Performed | 57.9 | 2.1 |
| 13 | C | 780 | 776 | 676 | 72.7 | Not performed | Performed | 39.8 | 2.3 |
| 14 | C | as the original electric resistance welded tube | | | | | | 146.0 | 2.0 |
| 15 | C | 735 | 730 | 628 | 48.5 | Performed | Not performed | 75.2 | 2.1 |
| 16 | D | 735 | 740 | 645 | 60.2 | Not performed | Performed | 58.1 | 2.1 |
| 17 | D | 780 | 776 | 676 | 72.5 | Not performed | Performed | 40.2 | 2.3 |
| 18 | D | as the original electric resistance welded tube | | | | | | 146.0 | 2.0 |
| 19 | E | 820 | 800 | 709 | 48.5 | Performed | Performed | 75.1 | 2.0 |

| Steel tube No. | Structure of product tube | | | Property of product tube | | | | | | Note |
|---|---|---|---|---|---|---|---|---|---|---|
| | Structure | ferrite area ratio (%) | ferrite grain diameter (μm) | 0.2% proof stress (MPa) | TS (MPa) | El (%) | TE value (MPa · %) | Lankford value | Crack generation rate in the combined forming (%) | |
| 1 | F | 100 | 8.1 | 515 | 598 | 23 | 26850 | — | 0/10 | Present example |
| 2 | F | 100 | 6.5 | 524 | 603 | 25 | 28281 | — | 0/10 | Present example |
| 3 | F | 100 | 5.6 | 520 | 615 | 26 | 29459 | — | 0/10 | Present example |
| 4 | F | 100 | 2.4 | 550 | 650 | 29 | 33085 | — | 0/10 | Present example |
| 5 | F | 100 | 30.1 | 500 | 590 | 18 | 23541 | — | 10/10 | Comparative example |
| 6 | F | 100 | 5.0 | 507 | 590 | 25 | 27671 | 0.55 | 0/10 | Present example |
| 7 | F | 100 | 4.2 | 520 | 600 | 27 | 29340 | 1.22 | 0/10 | Present example |
| 8 | F | 100 | 2.5 | 511 | 610 | 30 | 31659 | 1.32 | 0/10 | Present example |
| 9 | F, M | 98 | 2.0 | 545 | 650 | 32 | 35035 | 1.41 | 0/10 | Present example |
| 10 | F | 100 | 14.0 | 513 | 600 | 19 | 24540 | 0.38 | 10/10 | Comparative example |

TABLE 2-continued

| | | | | | | | | | | |
|---|---|---|---|---|---|---|---|---|---|---|
| 11 | F | 100 | 10.1 | 497 | 541 | 25 | 25373 | — | 0/10 | Present example |
| 12 | F | 100 | 7.6 | 498 | 542 | 25 | 25420 | — | 0/10 | Present example |
| 13 | F | 100 | 5.9 | 501 | 550 | 25 | 25795 | — | 0/10 | Present example |
| 14 | F | 100 | 13.0 | 463 | 505 | 23 | 22675 | — | 10/10 | Comparative example |
| 15 | F | 100 | 6.0 | 495 | 542 | 26 | 25962 | — | 0/10 | Present example |
| 16 | F | 100 | 6.0 | 500 | 549 | 25 | 25748 | — | 0/10 | Present example |
| 17 | F | 100 | 2.3 | 508 | 557 | 23 | 21021 | — | 0/10 | Present example |
| 18 | F | 100 | 12.5 | 450 | 490 | 21 | 21021 | — | 10/10 | Comparative example |
| 19 | F | 100 | 23.0 | 275 | 450 | 23 | 20205 | — | 10/10 | Comparative example |

F: Ferrite
M: Martensite

Example 2

Each of the steel tubes No. 6, No. 9, No. 10 shown in example 1 was subjected to the diameter-reducing process at a diameter-reducing rate of 20% as the secondary forming treatment and then to the heating treatment (880° C.×10 min.) as a heat refining treatment. Thereafter, each steel tube was air-cooled and then subjected to a heat treatment of tempering at 200° C., whereby a automobile structure member was obtained.

A test piece was taken from each of the obtained automobile structure members. A tensile test (in the longitudinal direction) according to JIS Z 2241 and a fatigue test according to JIS Z 2273 were carried out for each test piece. The fatigue test was conducted as a pulsating tension fatigue test, in which the fatigue limit (the number of cycles: $10^6$ times) was obtained.

The obtained results are shown in Table 3.

As shown in Table 3, in the present examples, the stainless steel tubes (Steel tube No. 6 and No. 9) having high tensile strength, excellent ductility and the TE value of more than 25,000 MPa were subjected to the diameter-reducing processing and then the heat refining treatment, whereby the automobile structure members (member No. 1 and No. 2) having high tensile strength and excellent fatigue resistance property were obtained. On the other hand, in the stainless steel tube (steel tube No. 10) whose properties did not satisfy the scope of the present invention, secondary forming treatment was not possible.

TABLE 3

| | | | | Size of product tube | | Structure | Property of product tube | | | |
|---|---|---|---|---|---|---|---|---|---|---|
| Member No. | Steel tube No | Steel No. | Diameter-reducing rolling | Outer diameter (mm) | Thickness (mm) | of product tube | 0.2% proof stress (MPa) | TS (MPa) | El (%) | TE value (MPa · %) |
| 1 | 6 | A | Performed | 101.6 | 2.0 | F | 507 | 590 | 25 | 27671 |
| 2 | 9 | A | Performed | 75.0 | 2.1 | F, M | 545 | 650 | 32 | 35035 |
| 3 | 10 | A | Unchanged from the original electric resistance welded tube | 146.0 | 2.1 | F | 513 | 600 | 19 | 24540 |

| | Diameter-reducing processing | Heat refining treatment | | Property of member | | |
|---|---|---|---|---|---|---|
| Member No. | Diameter-reducing rate (%) | Quenching ° C. | Tempering ° C. | Tensile strength (MPa) | Fatigue strength (MPa) | Note |
| 1 | 20 | 800 | 200 | 900 | 460 | Present example |
| 2 | 20 | | | 870 | 440 | Present example |
| 3 | Impossible to be processed | — | — | — | — | Comparative example |

F: Ferrite
M: Martensite

INDUSTRIAL APPLICABILITY OF THE PRESENT INVENTION

As described above, according to the present invention, a stainless steel tube which is used for a automobile structure member and exhibits excellent formability for secondary operation in diameter-reducing/increasing, bending, drawing and the like can be mass-produced, whereby a significantly advantageous effect can be achieved in the industrial terms.

What is claimed is:

1. A stainless steel tube for an automobile structure member having excellent formability for secondary operation comprising:

a chemical composition including not more than 0.20 mass % of C; not more than 1.5 mass % of Si; not more than 2.0 mass % of Mn; 10–18 mass % of Cr; not more than 0.03 mass % of N; Fe as the remainder and the inevitable impurities; and a structure which is constituted of ferrite or ferrite and martensite, wherein the TE value defined by the following formula (1) exceeds 25,000 MPa·%

$$TE \text{ value} = TS \times (El + 21.9) \quad (1)$$

in the aforementioned formula, TS represents the tensile strength in the tube axial direction (MPa), and El represents the elongation in the tube axial direction (%) of a tensile test piece having a cross-section with a width of 19 mm and a thickness of 2 mm, and having a gauge length of 50 mm, wherein the Lankford value is 0.5 or more, the diameter of ferrite grains is 8 $\mu$m or more, and the area ratio of martensite is 30% or less.

2. A stainless steel tube according to claim 1, further comprising, in addition to the aforementioned chemical composition, at least one type of element selected from the group consisting of: not more than 0.6 mass % of Cu; not more than 0.6 mass % of Ni; not more than 2.5 mass % of Mo; not more than 1.0 mass % of Nb; not more than 1.0 mass % of Ti; and not more than 1.0 mass % of V.

3. An automobile structure member having excellent fatigue resistance property, which member is produced by subjecting the stainless steel tube of claim 1 to a secondary forming treatment and a heat refining treatment so that the tensile strength thereof becomes not smaller than 800 MPa.

* * * * *